US009267725B2

(12) United States Patent
Jeon et al.

(10) Patent No.: US 9,267,725 B2
(45) Date of Patent: Feb. 23, 2016

(54) REFRIGERATOR

(71) Applicant: SAMSUNG ELECTRONICS CO., LTD., Suwon-si (KR)

(72) Inventors: Jeong Min Jeon, Suwon-si (KR); Sang Soo Kim, Gwangju (KR); Yong Han Kim, Cheonan-si (KR); Bong Su Son, Cheonan-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 286 days.

(21) Appl. No.: 13/935,811

(22) Filed: Jul. 5, 2013

(65) Prior Publication Data

US 2014/0007611 A1 Jan. 9, 2014

(30) Foreign Application Priority Data

Jul. 6, 2012 (KR) ..... 10-2012-0074210

(51) Int. Cl.

| | |
|---|---|
| ***F25D 17/06*** | (2006.01) |
| ***F25D 11/02*** | (2006.01) |
| ***F25D 23/00*** | (2006.01) |
| *F25B 39/04* | (2006.01) |
| *F25D 19/04* | (2006.01) |

(52) U.S. Cl.

CPC ..... *F25D 11/02* (2013.01); *F25D 23/003* (2013.01); *F25B 39/04* (2013.01); *F25D 19/04* (2013.01); *F25D 2323/00261* (2013.01); *F25D 2323/00271* (2013.01); *F25D 2400/14* (2013.01)

(58) Field of Classification Search

CPC F25D 17/065; F25D 2317/067; F25D 23/003
USPC ..... 62/407, 419, 455, 428
See application file for complete search history.

(56) References Cited

U.S. PATENT DOCUMENTS

| | | | | |
|---|---|---|---|---|
| 2,279,804 | A * | 4/1942 | Walz | 62/190 |
| 3,119,240 | A * | 1/1964 | Devery | 62/156 |
| 6,598,410 | B2 * | 7/2003 | Temmyo et al. | 62/179 |
| 2004/0163408 | A1 * | 8/2004 | Kim et al. | 62/428 |
| 2010/0192609 | A1 * | 8/2010 | Chae et al. | 62/291 |
| 2010/0192617 | A1 * | 8/2010 | Chae et al. | 62/419 |

FOREIGN PATENT DOCUMENTS

| | | |
|---|---|---|
| KR | 10-2011-0071167 | 6/2011 |
| KR | 10-2012-0011277 | 2/2012 |

* cited by examiner

*Primary Examiner* — Melvin Jones
(74) *Attorney, Agent, or Firm* — Staas & Halsey LLP

(57) ABSTRACT

A refrigerator having a freezer compartment and a refrigerator compartment that circulates a plurality of individual refrigerating cycles using a plurality of compressors so as to individually cool the freezer compartment and the refrigerator compartment. The refrigerator includes a plurality of compressors, a plurality of condensers, a plurality of expansion valves, and a plurality of evaporators. One of the plurality of condensers is disposed in a machine compartment and the other condenser is disposed outside the machine compartment so that a heat dissipation effect of the machine compartment may be improved and arrangement availability may be increased. Also, the refrigerator includes a plurality of compressors, a dual path condenser, a plurality of expansion valves, and a plurality of evaporators. The dual path condenser may have a plurality of individual condensation paths.

18 Claims, 16 Drawing Sheets

REFRIGERATOR

CROSS-REFERENCE TO RELATED APPLICATIONS

This application claims the priority benefit of Korean Patent Application No. 10-2012-0074210, filed on Jul. 6, 2012 in the Korean Intellectual Property Office, the disclosure of which is incorporated herein by reference.

BACKGROUND

1. Field

Embodiments of the present disclosure relate to a refrigerator that individually cools a freezer compartment and a refrigerator compartment using a plurality of compressors and a refrigerating unit for the refrigerator.

2. Description of the Related Art

In general, a refrigerator is a home appliance that keeps food fresh by including a storage compartment to store food and a refrigerating unit to supply cold air to the storage compartment in a refrigerating cycle. The storage compartment is divided into a refrigerator compartment in which food is refrigerated and a freezer compartment in which food is stored in a frozen state.

The refrigerating unit includes a compressor to compress the refrigerant into a gas state at a high temperature under a high pressure, a condenser to condense the compressed refrigerant into a liquid state, an expansion valve to expand the condensed refrigerant, and an evaporator to evaporate a liquid refrigerant so as to generate cold air.

A refrigerator according to the related art circulates one refrigerating cycle using one compressor so as to cool the refrigerator compartment and the freezer compartment in different temperature ranges. Thus, the evaporator of the storage compartment is subcooled, and waste of power consumption occurs.

SUMMARY

Therefore, it is an aspect of the present disclosure to provide a refrigerator having a refrigerating unit that circulates a plurality of refrigerating cycles using a plurality of compressors.

It is another aspect of the present disclosure to provide a machine compartment heat dissipation structure of a refrigerator having a refrigerating unit that circulates a plurality of refrigerating cycles using a plurality of compressors, whereby heat generated in a plurality of refrigerating cycles may be effectively dissipated.

It is another aspect of the present disclosure to provide a machine compartment arrangement structure of a refrigerator having a refrigerating unit that circulates a plurality of refrigerating cycles using a plurality of compressors, whereby a heat dissipation effect within a limited capacity of a machine compartment may be improved.

It is another aspect of the present disclosure to provide a structure of a dual path condenser that may dissipate heat generated in a plurality of refrigerating cycles effectively.

Additional aspects of the disclosure will be set forth in part in the description which follows and, in part, will be obvious from the description, or may be learned by practice of the disclosure.

In accordance with one aspect of the present disclosure, there is provided a refrigerator including: a body; a freezer compartment formed in the body; a refrigerator compartment that is formed in the body and insulated from the freezer compartment; a machine compartment insulated from the freezer compartment and the refrigerator compartment; a freezer compartment compressor disposed in the machine compartment so as to circulate a freezer compartment refrigerating cycle in which cold air is supplied to the freezer compartment; a refrigerator compartment compressor disposed in the machine compartment so as to circulate a refrigerator compartment refrigerating cycle in which cold air is supplied to the refrigerator compartment; a condenser disposed in the machine compartment so as to condense a refrigerant compressed by the freezer compartment compressor and/or to condense a refrigerant compressed by the refrigerator compartment compressor; and a blower fan disposed in the machine compartment so as to forcibly cause air to flow, wherein the freezer compartment compressor is disposed to be slanted toward one sidewall of the machine compartment from a center of an inside of the machine compartment, the refrigerator compartment compressor is disposed to be slanted to the other sidewall of the machine compartment from the center of the inside of the machine compartment, and the condenser is disposed between the freezer compartment compressor and the refrigerator compartment compressor, and the blower fan allows air to forcibly flow from the refrigerator compartment compressor to the freezer compartment compressor via the condenser.

The blower fan may be disposed between the refrigerator compartment compressor and the condenser, may absorb air from the refrigerator compartment compressor, and may eject air toward the condenser.

The refrigerator compartment compressor, the blower fan, the condenser, and the freezer compartment compressor may be successively disposed in one straight line.

The blower fan may be disposed between the condenser and the freezer compartment compressor, may absorb air from the condenser and may eject air toward the freezer compartment compressor.

The refrigerator compartment compressor, the condenser, the blower fan, and the freezer compartment compressor may be successively disposed in one straight line.

The machine compartment may have an open portion and may include a machine compartment cover that is detachably combined with the open portion of the machine compartment so as to open or close the open portion of the machine compartment.

An inlet through which air is introduced into the machine compartment and an outlet through which air flows out from the machine compartment, may be formed in the machine compartment cover.

The blower fan may be an axial flow fan.

In accordance with another aspect of the present disclosure, there is provided a refrigerator including: a body; a freezer compartment formed in the body; a refrigerator compartment that is formed in the body and insulated from the freezer compartment; a machine compartment insulated from the freezer compartment and the refrigerator compartment; a freezer compartment compressor disposed in the machine compartment so as to circulate a freezer compartment refrigerating cycle in which cold air is supplied to the freezer compartment; a refrigerator compartment compressor disposed in the machine compartment so as to circulate a refrigerator compartment refrigerating cycle in which cold air is supplied to the refrigerator compartment; and a blower fan disposed in the machine compartment so as to cool the machine compartment, wherein the blower fan allows air to forcibly flow from the refrigerator compartment compressor to the freezer compartment compressor.

The blower fan may be an axial flow fan, and the refrigerator compartment compressor, the blower fan, and the freezer compartment compressor may be successively disposed in one straight line.

The freezer compartment compressor may be disposed to be slanted toward one sidewall of the machine compartment from a center of an inside of the machine compartment, and the refrigerator compartment compressor may be disposed to be slanted toward the other sidewall of the machine compartment from the center of the inside of the machine compartment.

The refrigerator may further include: a freezer compartment condenser that condenses a refrigerant compressed by the freezer compartment compressor; and a refrigerator compartment condenser that condenses a refrigerant compressed by the refrigerator compartment compressor, wherein one of the freezer compartment condenser and the refrigerator compartment condenser is disposed between the freezer compartment compressor and the refrigerator compartment compressor in the machine compartment.

The refrigerator may further include a dual path condenser having a first condensation path on which a refrigerant compressed by the freezer compartment compressor is condensed, and a second condensation path on which a refrigerant compressed by the refrigerator compartment compressor is condensed and which is formed independently of the first condensation path, wherein the dual path condenser is disposed between the freezer compartment compressor and the refrigerator compartment compressor in the machine compartment.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
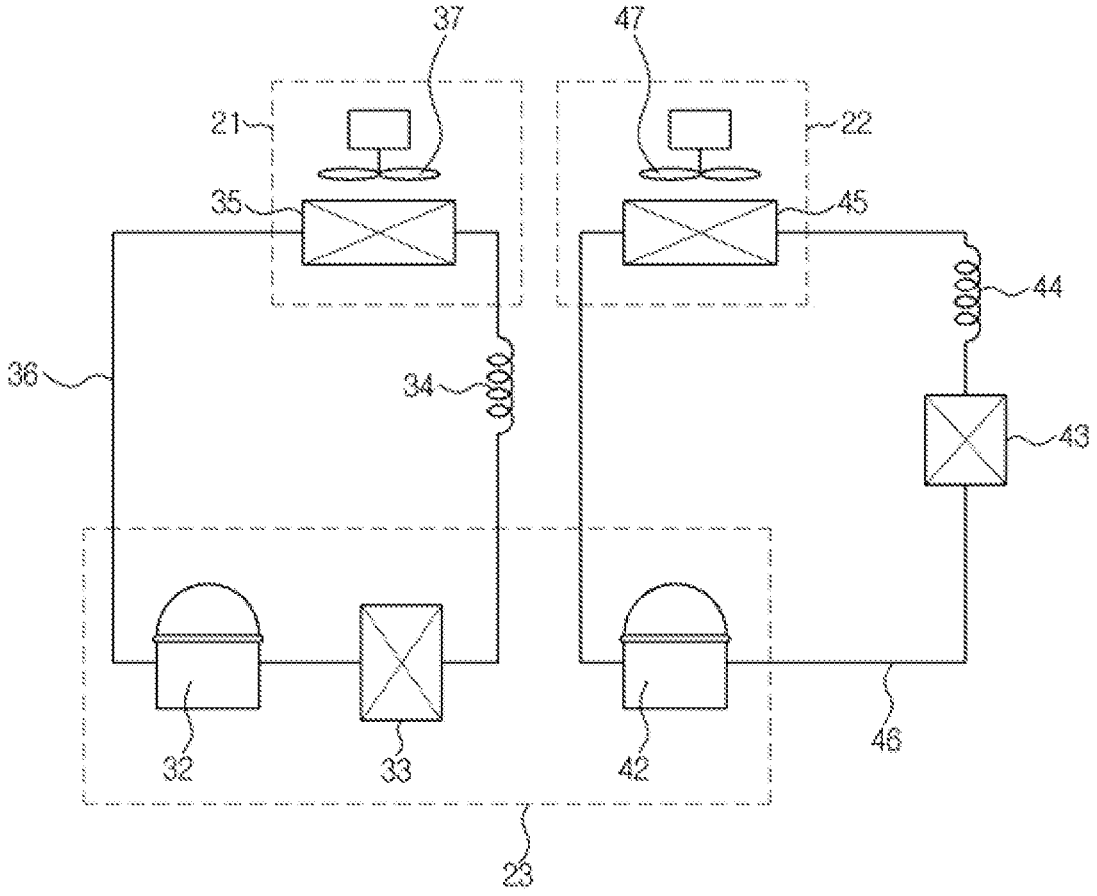
FIG. 1 is a view illustrating a refrigerating cycle of a refrigerator according to an embodiment of the present disclosure.

Reference will now be made in detail to embodiments of the present disclosure, examples of which are illustrated in the accompanying drawings, wherein like reference numerals refer to like components throughout.

Figure 2:
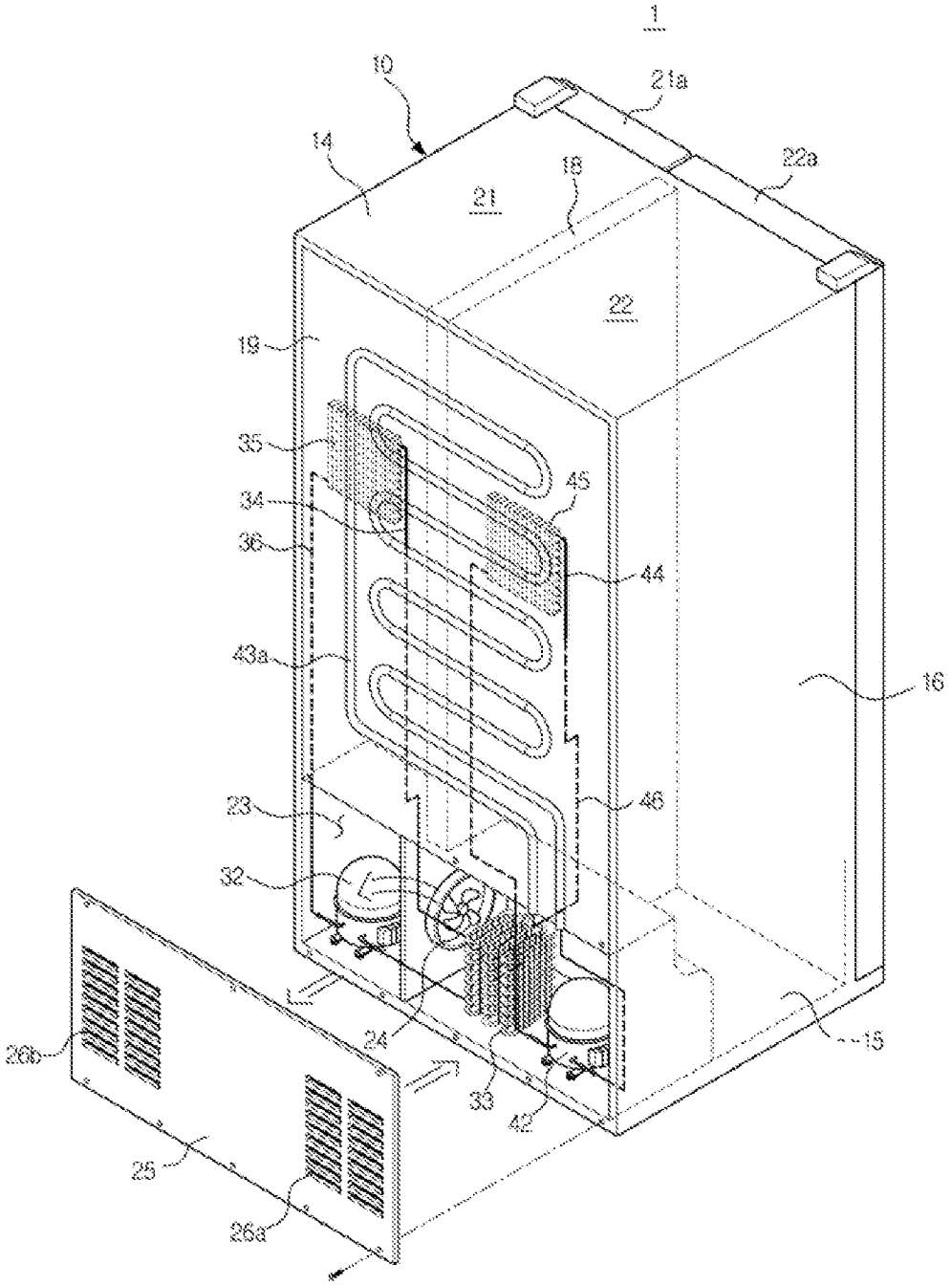
FIG. 2 is a view illustrating an arrangement structure of a refrigerating unit of a refrigerator according to an embodiment of the present disclosure.
Figure 3:
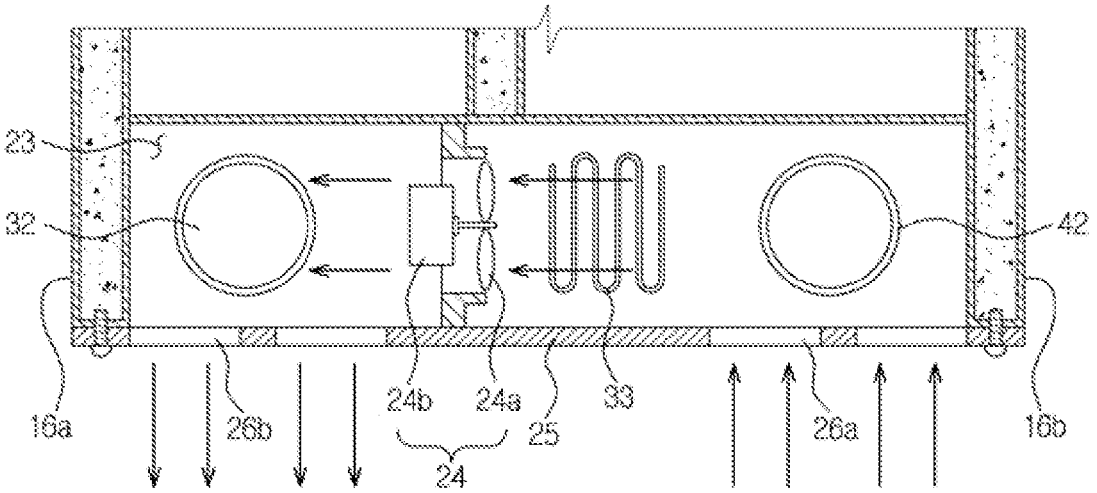
FIG. 3 is a cross-sectional view illustrating an arrangement structure of a machine compartment of the refrigerator of FIG. 2.
Figure 4:
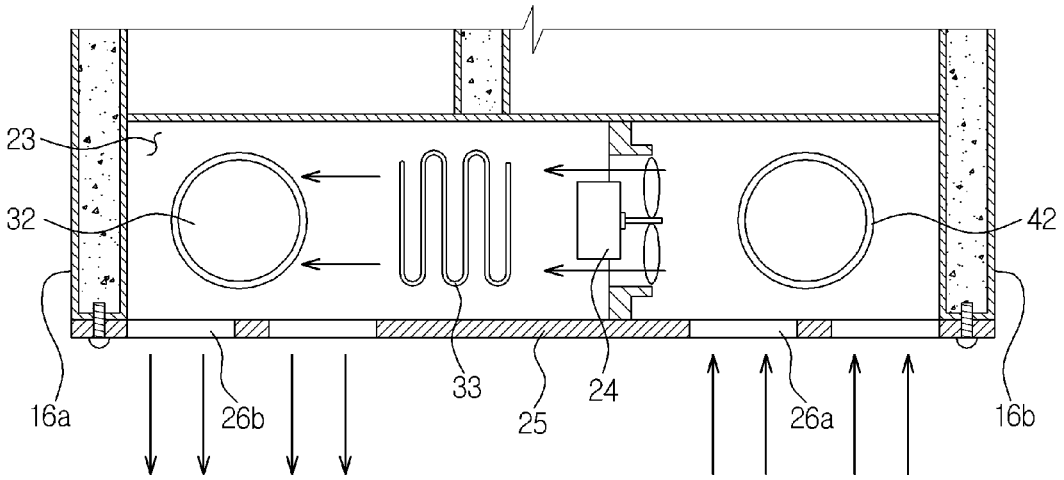
FIG. 4 is a cross-sectional view illustrating another arrangement structure of a machine compartment of a refrigerator according to an embodiment of the present disclosure.

FIG. 1 is a view illustrating a refrigerating cycle of a refrigerator 1 according to an embodiment of the present disclosure, FIG. 2 is a view illustrating an arrangement structure of a refrigerating unit of the refrigerator 1 according to an embodiment of the present disclosure, FIG. 3 is a cross-sectional view illustrating an arrangement structure of a machine compartment of the refrigerator 1 of FIG. 2, and FIG. 4 is a cross-sectional view illustrating another arrangement structure of a machine compartment of the refrigerator 1 according to an embodiment of the present disclosure.

Referring to FIGS. 1 through 4, the refrigerator 1 according to an embodiment of the present disclosure includes a body 10, a plurality of storage compartments 21 and 22 formed in the body 10 so as to store food, and a refrigerating unit that supplies cold air to the storage compartments 21 and 22.

The body 10 may include an inner case (see 11 of FIG. 6), an outer case (see 12 of FIG. 6) combined with an outer portion of the inner case 11, and a heat insulating material (see 13 of FIG. 6) disposed between the inner case 11 and the outer case 12. The plurality of storage compartments 21 and 22 are formed in the inner case 11, and the inner case 11 may be formed of a resin as one body. The outer case 12 forms the exterior of the refrigerator 1 and may be formed of a metal so as to be esthetically appealing and durable.

The heat insulating material 13 may be a urethane foam and may be formed by injecting a urethane undiluted solution into the space between the inner case 11 and the outer case 12 after the inner case 11 and the outer case 12 are combined with each other and by foaming and hardening the urethane undiluted solution.

The body 10 may have the shape of a box having an open front portion. The body 10 may have an upper wall 14, a bottom wall 15, a rear wall 19, and both sidewalls 16. Also, the body 10 may have an intermediate wall 18 that partitions the inner space of the body 10 into left/right storage compartments, or upper/lower compartments (not shown). The storage compartments 21 and 22 may be divided into a right, first storage compartment 21 and a left, second storage compartment 22 by the intermediate wall 18. Further, the intermediate wall 18 may include the heat insulating material 13, and the first storage compartment 21 and the second storage compartment 22 may be insulated from each other.

Thus, the first storage compartment 21 and the second storage compartment 22 are disposed so that their front portions are open, the open front portion of the first storage compartment 21 may be opened or closed by a first door 21*a*, and the open front portion of the second storage compartment 22 may be opened or closed by a second door 22*a*. The first door 21*a* and the second door 22*a* may be hinge-coupled to the body 10 and may rotate.

The body 10 further includes a front border wall (see 17 of FIG. 8), and the first door 21*a* and the second door 22*a* closely contact the front border wall 17 so as to seal the first storage compartment 21 and the second storage compartment 22. The first door 21*a* and the second door 22*a* may include the heat insulating material 13 so as to insulate the first storage compartment 21 and the second storage compartment 22 from each other.

A refrigerator 1 according to an present embodiment may be a so-called side-by-side refrigerator in which the first storage compartment 21 is formed in a right inner portion of the body 10, the second storage compartment 22 is formed in a left inner portion of the body 10 and each of the compartments 21 and 22 is opened or closed by the rotating first and second doors 21*a* and 22*a* that are hinge-coupled to the body 10. Hereinafter, refrigerators according to other embodiments will be described on the assumption that they are side-by-side refrigerators. However, the spirit of the present disclosure is not limited to these side-by-side refrigerators, and any type of refrigerator having a plurality of storage compartments 21 and 22 may be used.

The first storage compartment 21 and the second storage compartment 22 may be used for different purposes. That is, the first storage compartment 21 may be used as a freezer compartment, which is maintained at a temperature of about −20° C. or less and in which food may be kept in a frozen state, and the second storage compartment 22 may be used as a refrigerator compartment, which is maintained at a temperature of about 0° C. to 5° C. and in which food may be refrigerated. The purposes of the first storage compartment 21 and the second storage compartment 22 may be changed. For example, the first storage compartment 21 may be used as a refrigerator compartment and the second storage compartment 22 may be used a freezer compartment. However, the following description is on the assumption that the first storage compartment 21 is used as a freezer compartment and the second storage compartment 22 is used as a refrigerator compartment.

The refrigerating unit of the refrigerator 1 according to an present embodiment may circulate a plurality of individual refrigerating cycles so as to individually cool the first storage compartment 21 and the second storage compartment 22. To this end, the refrigerating unit may include a first refrigerating unit that supplies cold air to the first storage compartment 21 and a second refrigerating unit that supplies cold air to the second storage compartment 22.

The first refrigerating unit may circulate a first refrigerant, and the second refrigerating unit may circulate a second refrigerant that is separate from the first refrigerant. However, names, such as the first refrigerant and the second refrigerant, are used only to differentiate refrigerants that circulate in different refrigerating cycles through different refrigerating units from each other, and it does not mean that the types of the first refrigerant and the second refrigerant are different from each other. That is, the first refrigerant and the second refrigerant may be of the same type or different types. The first refrigerant and the second refrigerant may be one selected from the group consisting of R-134a, R-22, R-12, and ammonia. However, the present disclosure is not limited thereto, and any suitable refrigerant known in the art may be used by those skilled in the art.

The first refrigerating unit may include a first compressor 32 to compress the first refrigerant at a high temperature under a high pressure, a first condenser 33 to condense the first refrigerant from a gaseous state to a liquid state, a first expansion valve 34 to expand the first refrigerant at a low temperature under a low pressure, a first evaporator 35 to evaporate the first refrigerant from a liquid state to a gaseous state, a first refrigerant pipe 36 to guide the first refrigerant to components of the first refrigerating unit successively, and a first blower fan 37 that forcibly causes the air of the first storage compartment 21 to flow.

Here, the first evaporator 35 may evaporate the first refrigerant and may take peripheral latent heat so as to generate cold air, and the generated cold air may be supplied to the first storage compartment 21 through the first blower fan 37.

The first compressor 32 may be a hermetic reciprocation acting compressor, and the first condenser 33 may be an air-cooled condenser having heat dissipation fins and a tube.

The first compressor 32 and the first condenser 33 may be disposed in a machine compartment 23 formed in a lower portion of the body 10. The machine compartment 23 is partitioned off from the storage compartments 21 and 22 and is insulated therefrom.

One portion of the machine compartment 23 is open, and a machine compartment cover 25 may be detachably combined with the open portion of the machine compartment 23. Ventilators 26*a* and 26*b* may be formed in the machine compartment cover 25. The ventilators 26*a* and 26*b* may include an inlet 26*a* through which the air is introduced and an outlet 26*b* through which the air flows out. A machine compartment blower fan 24 may be disposed in the machine compartment 23.

The second refrigerating unit may include a second compressor 42 to compress the second refrigerant at a high temperature under a high pressure, a second condenser 43 to condense the second refrigerant from a gaseous state to a liquid state, a second expansion valve 44 to expand the second refrigerant at a low temperature under a low pressure, a second evaporator 45 to evaporate the second refrigerant from a liquid state to a gaseous state, a second refrigerant pipe 46 to guide the second refrigerant to components of the second refrigerating unit successively, and a second blower fan 47 that forcibly causes the air of the second storage compartment 22 to flow.

The second evaporator 45 may evaporate the second refrigerant and may take peripheral latent heat so as to generate cold air. The generated cold air may be supplied to the second storage compartment 22 through the second blower fan 47.

The second compressor 42 may be a hermetic reciprocation acting compressor that is the same as the first compressor 32. However, the second compressor 42 may have a smaller load than the first compressor 32 and thus may have a smaller size than the first compressor 32. Also, the second compressor 42 may be disposed in the machine compartment 23 together with the first compressor 32 and the first condenser 33. The second compressor 42 may be cooled by forcible flow of air caused by the machine compartment blower fan 24 together with the first compressor 32 and the first condenser 33. The second condenser 43 may be disposed in the machine compartment 23. (not shown).

However, the second condenser 43 may not be disposed in the machine compartment 23, unlike the first compressor 32, the first condenser 33, and the second compressor 42. Also, the second condenser 43 may be a heat dissipation pipe 43*a*, unlike the first condenser 33. The heat dissipation pipe 43*a* may have heat dissipation fins attached thereto. However, the heat dissipation fins may not be attached to the heat dissipation pipe 43*a*. Instead, the heat dissipation pipe 43*a* may have a shape that is bent in a zigzag form several times, so as to increase a heat dissipation area.

The heat dissipation pipe 43*a* may be disposed on an outer portion of the rear wall 19 of the body 10 so as to be exposed to the outside, as illustrated in FIG. 2. Furthermore, the heat dissipation pipe 43*a* may be attached to the outer surface of the outer case 12 so that heat of the heat dissipation pipe 43*a* may be transferred to the outer case 12 and the heat dissipation area may be further increased. The heat dissipation pipe 43*a* may be cooled by natural convection of air.

In this way, not all of the first compressor 32, the first condenser 33, the second compressor 42, and the second condenser 43 are disposed in the machine compartment 23 but the first compressor 32, the first condenser 33, and the second compressor 42 are disposed in the machine compartment 23, and the second condenser 43 is disposed outside the machine compartment 23 so that complexity of the machine compartment 23 may be reduced and a heat dissipation effect may be improved.

All of the first compressor 32, the first condenser 33, the second compressor 42, and the second condenser 43 may be disposed in the machine compartment 23. However, this may reduce the space of the storage compartments 21 and 22 compared to the size of the body 10 because the space of the machine compartment 23 may be increased to accommodate all the components mentioned above.

The internal arrangement of the machine compartment 23 may be configured in such that the first compressor 32 is disposed at one side of the inside of the machine compartment 23 and the second compressor 42 is disposed at the other side of the inside of the machine compartment 23, as illustrated in FIGS. 2 and 3. That is, the first compressor 32 may be disposed to be near one sidewall 16*a* of the machine compartment 23 from the center of the inside of the machine compartment 23, and the second compressor 42 may be disposed to be near the other sidewall 16*b* of the machine compartment 23 from the center of the inside of the machine compartment 23. The first compressor 32 may be disposed to be slanted toward one sidewall 16*a* of the machine compartment 23 from the center of the inside of the machine compartment 23, and the second compressor 42 may be disposed to be slanted toward the other sidewall 16*b* of the machine compartment 23 from the center of the inside of the machine compartment 23.

As illustrated in FIGS. 2 and 3, the first compressor 32 is disposed at a lower portion of the first storage compartment 21, and the second compressor 42 is disposed at a lower portion of the second storage compartment 22. However, aspects of the present disclosure are not limited thereto, and the positions of the first compressor 32 and the second compressor 42 may be changed. However, in consideration of a load applied to the bottom wall 15, it is sufficient if the first compressor 32 and the second compressor 42 are disposed at both portions of the machine compartment 23.

In addition, the first condenser 33 and the machine compartment blower fan 24 may be disposed between the first compressor 32 and the second compressor 42, for example, in approximately one straight line. In FIGS. 2 and 3, the first compressor 32, the machine compartment blower fan 24, the first condenser 33, and the second compressor 42 are successively disposed. However, unlike this, the first compressor 32, the first condenser 33, the machine compartment blower fan 24, and the second compressor 42 may be successively disposed, as illustrated in FIG. 4.

In this case, the machine compartment blower fan 24 may include fan wings 24*a* that forcibly cause the air to flow and a fan motor 24*b* that drives the fan wings 24*a*. The machine compartment blower fan 24 may be an axial flow fan in which a direction of wind is the same as a direction of a rotation shaft.

Also, the wind direction of the machine compartment 23 may be directed from the second compressor 42 toward the first compressor 32. That is, the air that is introduced into the machine compartment 23 through the inlet 26*a* may cool the second compressor 42, the first condenser 33, and the first compressor 32 successively and may flow out from the machine compartment 23 through the outlet 26*b*.

That is, in the arrangement structure of FIG. 3, the machine compartment blower fan 24 absorbs the air from the first condenser 33 and ejects the air toward the first compressor 32, and in the arrangement structure of FIG. 4, the machine compartment blower fan 24 absorbs the air from the second compressor 42 and ejects the air toward the first condenser 33.

Due to this wind direction, heat dissipation of the first compressor 32 (freezer compartment) having a relatively larger amount of heat generation than the second compressor 42 may be prevented from affecting heat dissipation of the first condenser 33 and the second compressor 42 (refrigerator compartment), and energy consumed for heat dissipation of the machine compartment 23 may be reduced. Thus, damage caused by a lowered heat exchange efficiency of the first condenser 33 and overload of the second compressor 42 may be prevented.

Figure 5:
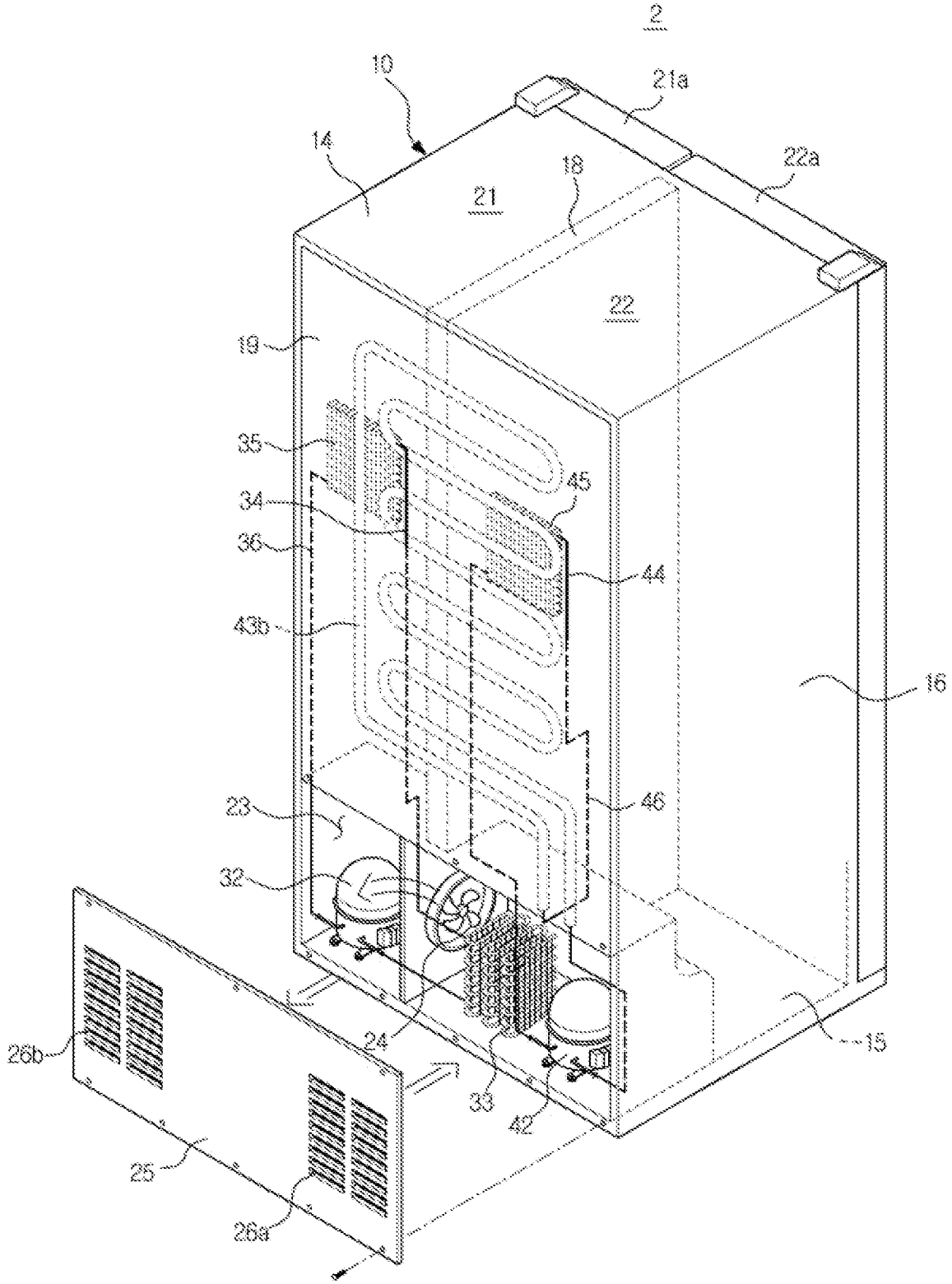
FIG. 5 is a view illustrating an arrangement structure of a refrigerating unit of a refrigerator according to another embodiment of the present disclosure.
Figure 6:
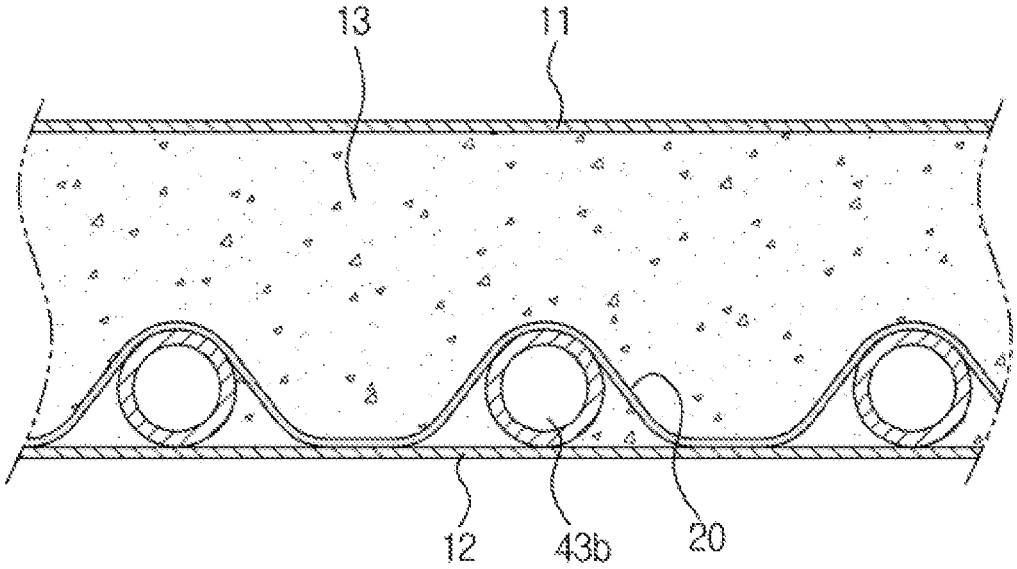
FIG. 6 is a view illustrating a state in which a heat dissipation pipe is installed at the refrigerator of FIG. 5.

FIG. 5 is a view illustrating an arrangement structure of a refrigerating unit of a refrigerator 2 according to another embodiment of the present disclosure, and FIG. 6 is a view illustrating a state in which a heat dissipation pipe is installed at the refrigerator 2 of FIG. 5.

The arrangement structure of a refrigerating unit of the refrigerator 2 according to another embodiment of the present disclosure will be described with reference to FIGS. 5 and 6. Like reference numerals are used for like components from FIGS. 1 through 4, and the description thereof may be omitted.

The refrigerating unit of the refrigerator 2 according to the present embodiment has the same configuration as the refrigerator 1 of FIG. 1 except for the position of a second compressor.

That is, the second condenser is configured as a heat dissipation pipe 43*b*, and the heat dissipation pipe 43*b* may be disposed in a rear wall 19 of a body 10, unlike in FIGS. 1 through 4.

In detail, the heat dissipation pipe 43*b* may be disposed between an inner case 11 and an outer case 12 of the rear wall 19. In particular, the heat dissipation pipe 43*b* may be disposed to contact the inner surface of the outer case 12. In this case, the heat dissipation pipe 43*b* may be attached to the inner surface of the outer case 12 using a tape having high thermal conductivity, for example, an aluminum tape 20.

Thus, heat of a refrigerant that passes through the heat dissipation pipe 43*b* may be transferred to the outer case 12 via the aluminum tape 20 or may be dissipated through the outer case 12 by natural convection of air. Also, heat of the refrigerant that passes through the heat dissipation pipe 43*b* may be prevented from being transferred to the inner case 11 using a heat insulating material 13. Thus, the risk of heat of the heat dissipation pipe 43*b* penetrating into storage compartments 21 and 22 may be prevented.

The heat dissipation pipe 43*b* may be attached to the inner surface of the outer case 12 using the aluminum tape 20 before the inner case 11 and the outer case 12 are combined with each other, and after the inner case 11 and the outer case 12 are combined with each other, the heat dissipation pipe 43*b* may be firmly supported by the heat insulating material 13 that foams and is hardened in the space between the inner case 11 and the outer case 12.

In this manner, the heat dissipation pipe 43*b* is disposed between the inner case 11 and the outer case 12 and thus may not be exposed to the outside. Thus, a sufficient arrangement space of the refrigerator 2 compared to the refrigerator 1 of FIG. 1 may be obtained, and the appearance of the refrigerator 2 may be improved.

Figure 7:
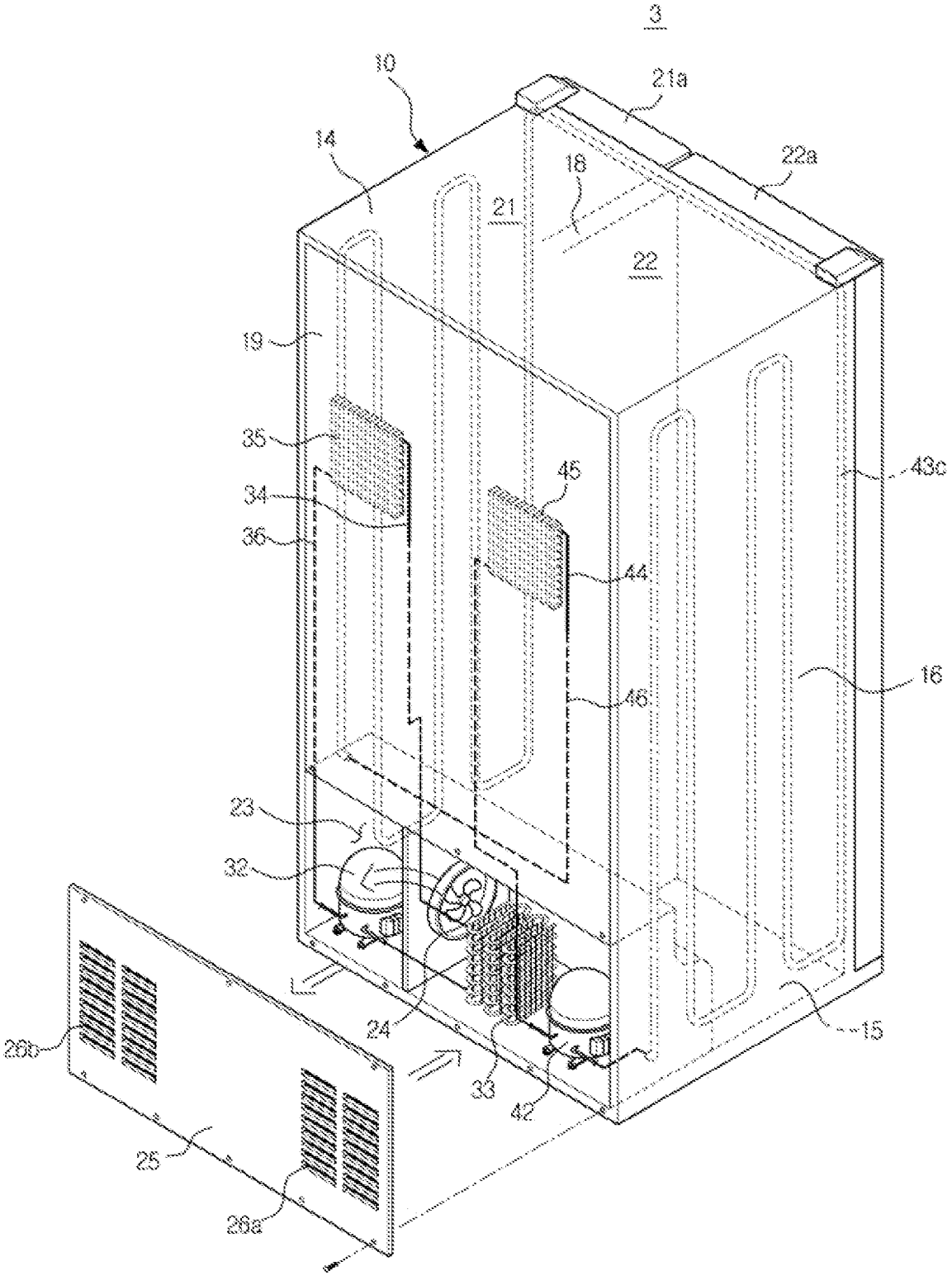
FIG. 7 is a view illustrating an arrangement structure of a refrigerating unit of a refrigerator according to another embodiment of the present disclosure.
Figure 8:
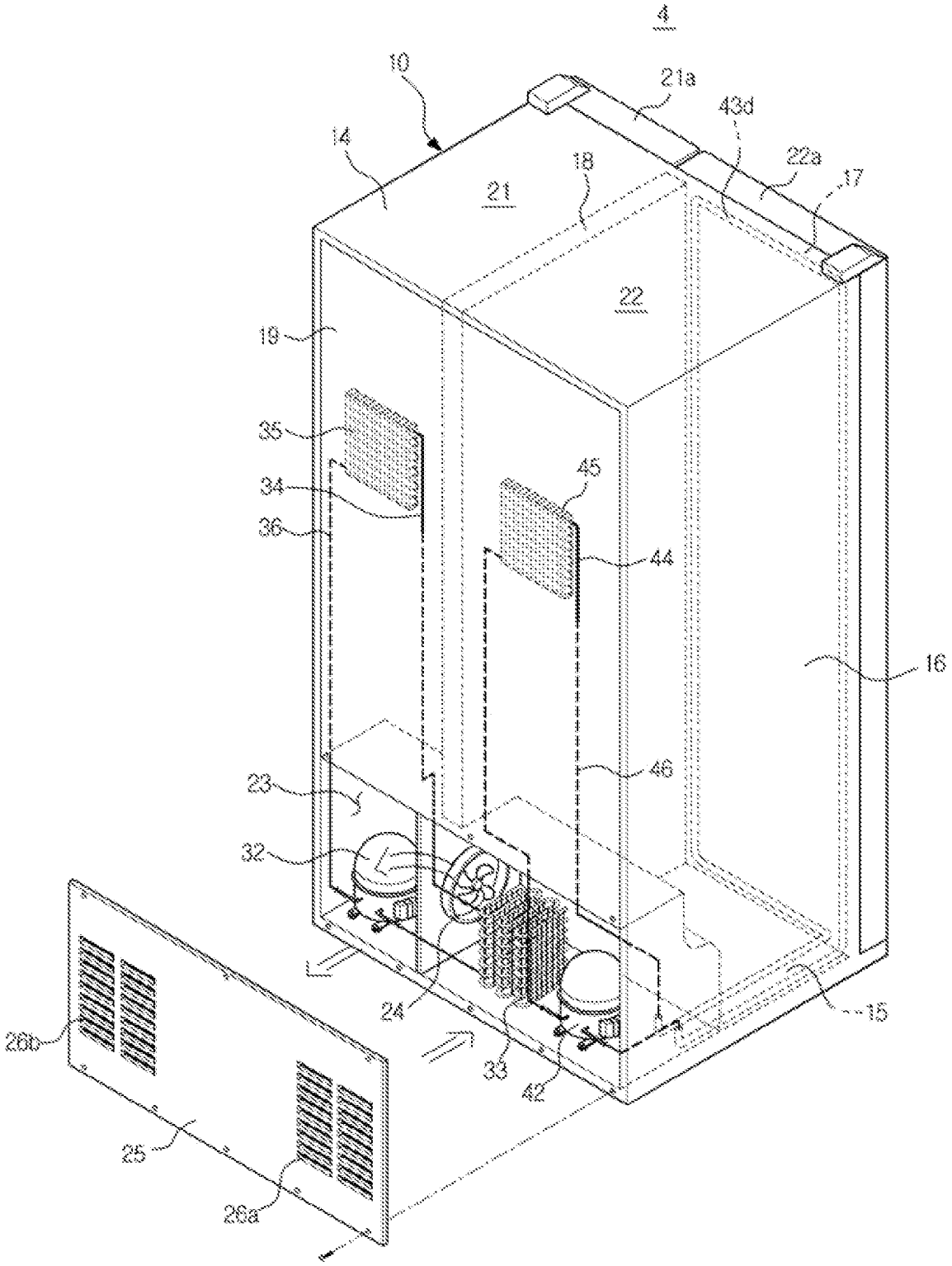
FIG. 8 is a view illustrating an arrangement structure of a refrigerating unit of a refrigerator according to another embodiment of the present disclosure.

FIG. 7 is a view illustrating an arrangement structure of a refrigerating unit of a refrigerator 3 according to another embodiment of the present disclosure, and FIG. 8 is a view illustrating an arrangement structure of a refrigerating unit of a refrigerator 4 according to another embodiment of the present disclosure.

The arrangement structure of the refrigerating unit of the refrigerator 3 according to another embodiment of the present disclosure and the arrangement structure of the refrigerating unit of the refrigerator 4 according to another embodiment of the present disclosure will be described with reference to FIGS. 7 and 8. Like reference numerals are used for like components from FIGS. 1 through 4 and FIGS. 5 and 6, and the description thereof may be omitted.

As illustrated in FIG. 7, a second condenser of the refrigerator 3 according to the present embodiment is configured as a heat dissipation pipe 43*c*, and the heat dissipation pipe 43*c* may be disposed on both sidewalls 16 of a body 10.

As in FIGS. 5 and 6, the heat dissipation pipe 43*c* may be disposed between an inner case (see 11 of FIG. 5) and an outer case (see 12 of FIG. 5), may be attached to the inner surface of the outer case 12 using a tape having high thermal conductivity such as an aluminum tape (see 20 of FIG. 5), and may be supported by a heat insulating material (see 13 of FIG. 5).

As illustrated in FIG. 8, a second condenser of the refrigerator 4 according to the present embodiment is configured as a heat dissipation pipe 43*d*, and the heat dissipation pipe 43*d* may be disposed on a front border wall 17 of the body 10.

As in FIGS. 5 and 6 and FIG. 7, the heat dissipation pipe 43*d* may be disposed between an inner case (see 11 of FIG. 5) and an outer case (see 12 of FIG. 5), may be attached to the inner surface of the outer case 12 using an aluminum tape (see 20 of FIG. 5), and may be supported by a heat insulating material (see 13 of FIG. 5). In this case, the heat dissipation pipe 43*d* may perform the function of preventing frost formation on the front border wall 17 due to a temperature change caused by opening/closing doors 21*a* and 22*a*. In FIG. 8, the heat dissipation pipe 43*d* is disposed only in a place at which the second door 22*a* closely contacts the front border wall 17. However, of course, the heat dissipation pipe 43*d* may extend and may be installed at a place at which the first door 21*a* closely contacts the front border wall 17.

As above, configurations and arrangements of the refrigerating units illustrated in FIGS. 1 through 8 have been described. In this way, the first compressor 32, the first condenser 33, and the second compressor 42 are cooled by forcible flow of air caused by the machine compartment blower fan 24, and the second condenser 43 is disposed outside the machine compartment 23 and is cooled by natural convection of air. Thus, cooling in a plurality of refrigerating cycles that are individually circulated may be effectively performed, the refrigerating units may be disposed without increasing the capacity of the machine compartment 23, and energy consumed for heat dissipation of the machine compartment 23 may be reduced.

Figure 9:
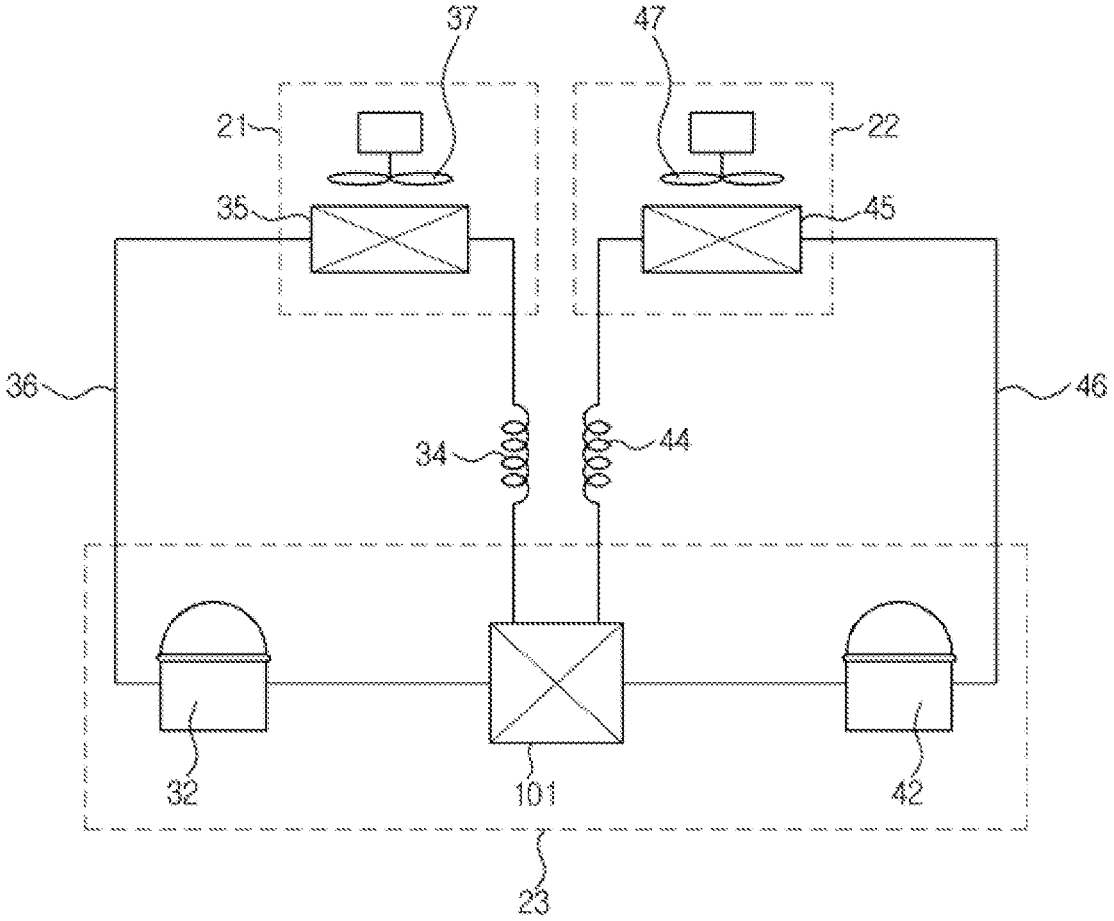
FIG. 9 is a view illustrating a refrigerating cycle of a refrigerator according to another embodiment of the present disclosure.
Figure 10:
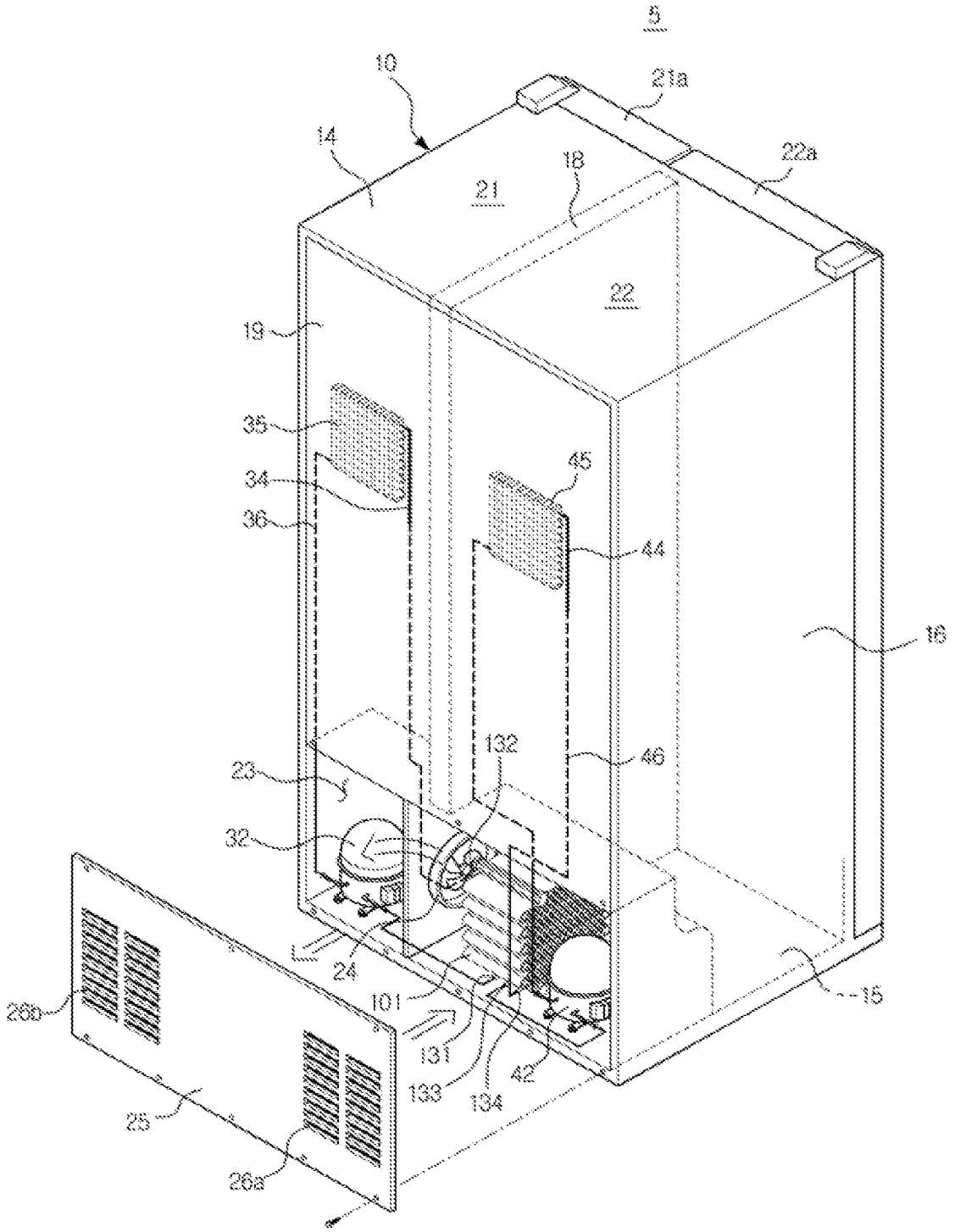
FIG. 10 is a view illustrating an arrangement structure of a refrigerating unit of a refrigerator according to another embodiment of the present disclosure.

FIG. 9 is a view illustrating a refrigerating cycle of a refrigerator 5 according to another embodiment of the present disclosure, and FIG. 10 is a view illustrating an arrangement structure of a refrigerating unit of the refrigerator 5 according to another embodiment of the present disclosure.

The refrigerating cycle of the refrigerator 5 and the structure of the refrigerating unit according to another embodiment of the present disclosure will be described with reference to FIGS. 9 and 10. Like reference numerals are used for like components from FIGS. 1 through 8, and the description thereof may be omitted.

The refrigerating unit of the refrigerator 5 according to the present embodiment may also circulate a plurality of individual refrigerating cycles so as to individually cool a first storage compartment 21 and a second storage compartment 22, as illustrated in FIGS. 1 through 8. To this end, the refrigerating unit may include a first refrigerating unit to supply cold air to the first storage compartment 21 and a second refrigerating unit to supply cold air to the second storage compartment 22. The first refrigerating unit may circulate a first refrigerant, and the second refrigerating unit may circulate a second refrigerant that is separate from the first refrigerant.

The first refrigerating unit may include a first compressor 32, a dual path condenser 101, a first expansion valve 34, a first evaporator 35, a first blower fan 37, and a first refrigerant pipe 36, and the second refrigerating unit may include a second compressor 42, a dual path condenser 101, a second expansion valve 44, a second evaporator 45, a second blower fan 47, and a second refrigerant pipe 46.

That is, the first refrigerating unit and the second refrigerating unit may share the dual path condenser 101 to condense the refrigerant. The dual path condenser 101 may be a condenser in which a plurality of condensers are integrated with each other, so as to increase space utility and heat exchange efficiency. The dual path condenser 101 may include a first condensation path (see 141 of FIG. 13) through which the first refrigerant passes, and a second condensation path (see 142 of FIG. 3) through which the second refrigerant passes and may condense both the first refrigerant and the second refrigerant. Here, the first condensation path 141 and the second condensation path 142 are individually formed. The detailed configuration of the dual path condenser 101 will be described again later.

As illustrated in FIGS. 9 and 10, the dual path condenser 101 may be disposed in a machine compartment 23 together with the first compressor 32 and the second compressor 42. Since both the first refrigerant in a first refrigerating cycle and the second refrigerant in a second refrigerating cycle may be condensed by the dual path condenser 101, no additional condenser other than the dual path condenser 101 may be needed in the refrigerator 5 illustrated in FIGS. 9 and 10.

The internal arrangement of the machine compartment 23 may be the same as those of FIGS. 1 through 8. That is, the first compressor 32 and the second compressor 42 may be disposed at both sides of the machine compartment 23, and the dual path condenser 101 may be disposed between the first compressor 32 and the second compressor 42. A machine compartment blower fan 24 may allow wind to blow in directions of the second compressor 42, the dual path condenser 101, and the first compressor 32.

Figure 11:
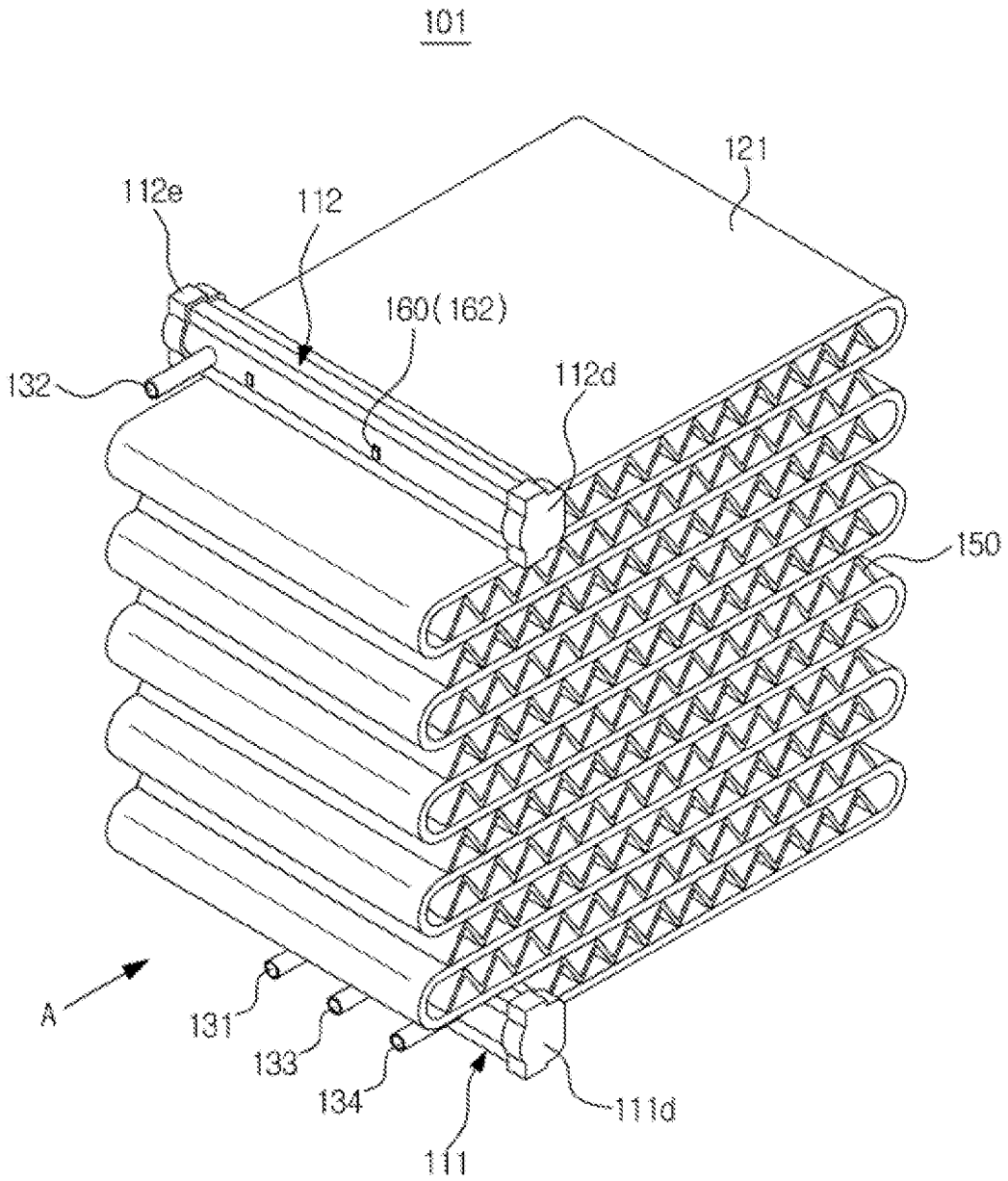
FIG. 11 is a view illustrating a dual path condenser of the refrigerator of FIG. 10.
Figure 12:
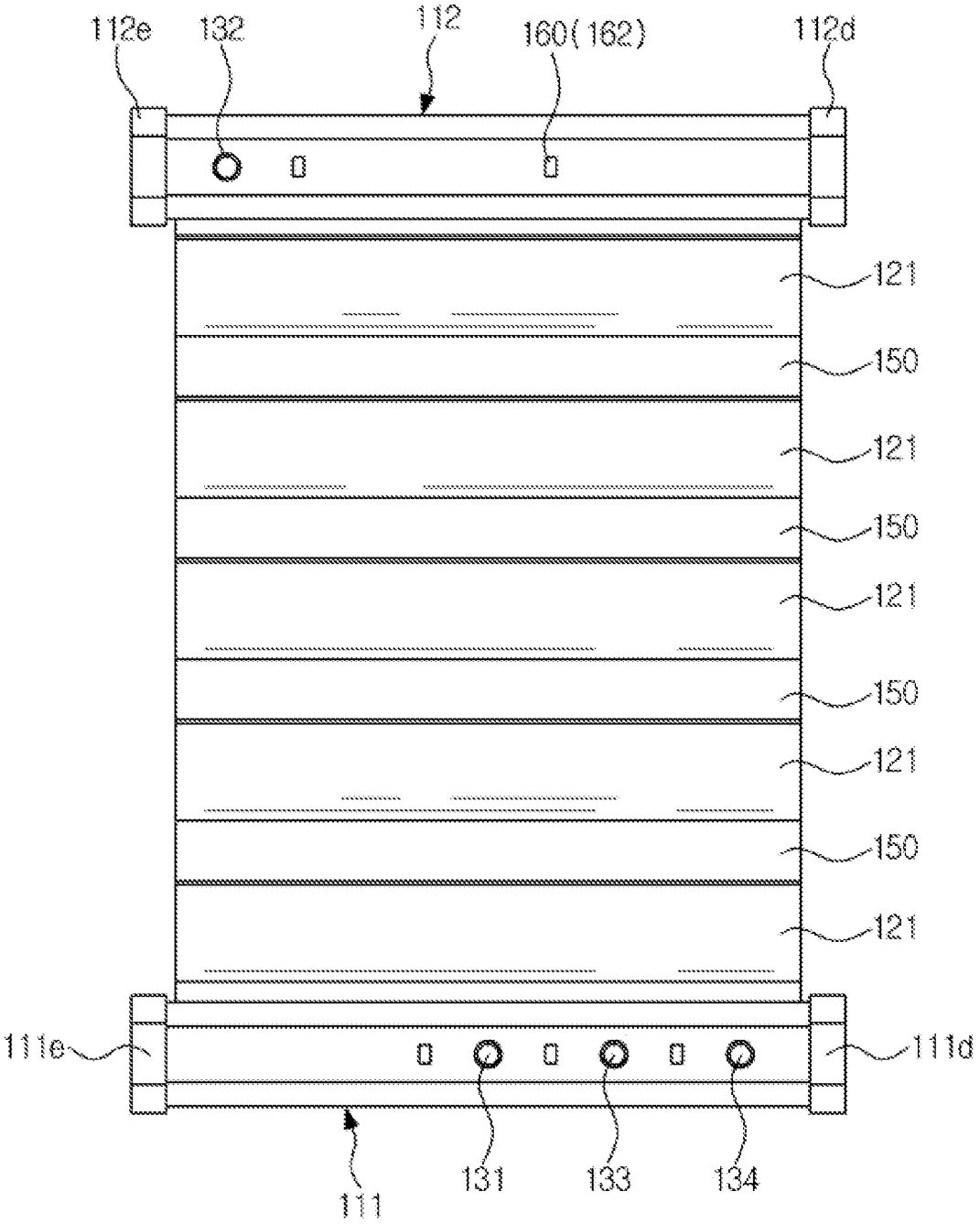
FIG. 12 is a view illustrating the dual path condenser of the refrigerator of FIG. 11 in an A direction.
Figure 13:
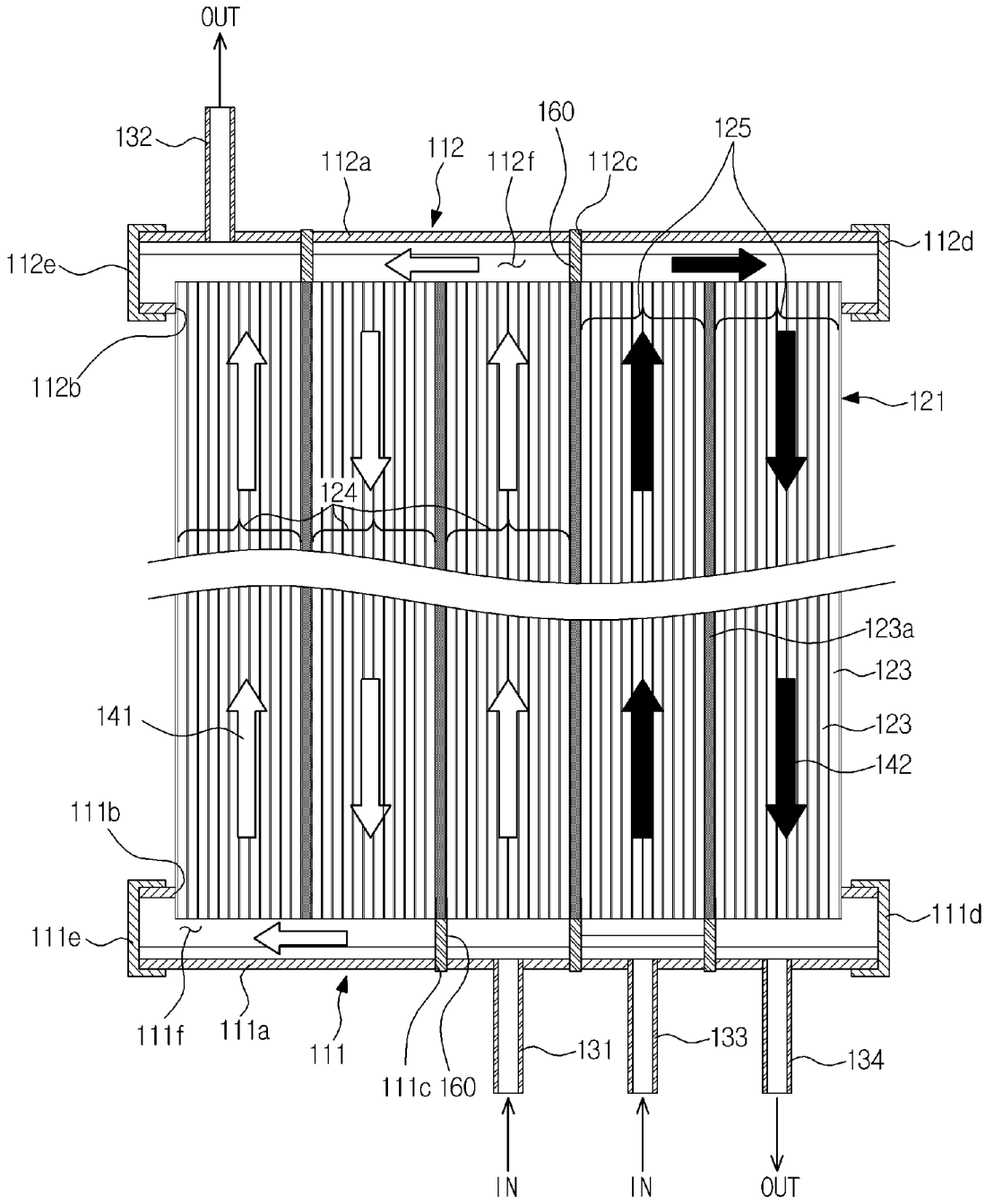
FIG. 13 is a view illustrating a state in which condensation paths of the dual path condenser of the refrigerator of FIG. 12 are unfolded.
Figure 14:
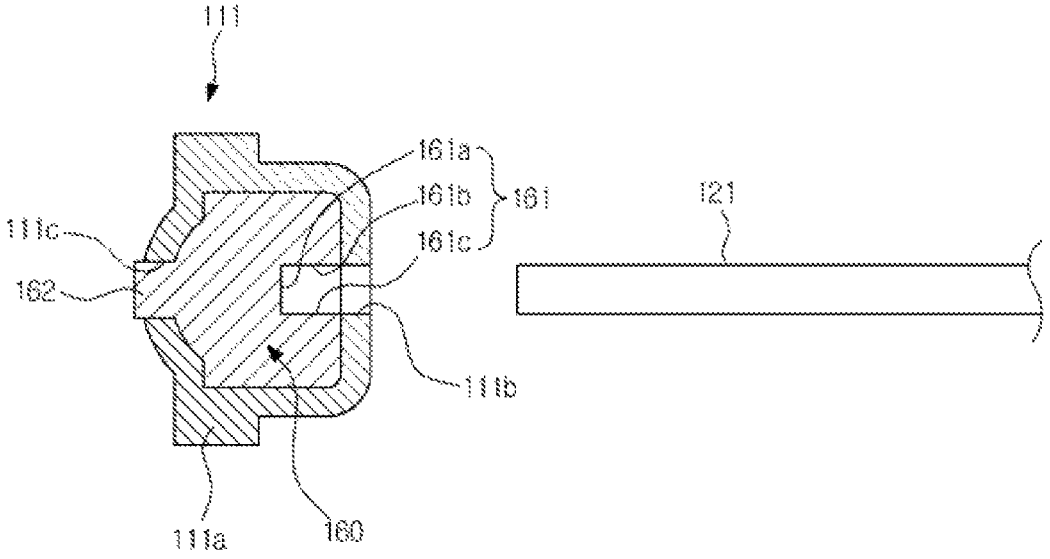
FIG. 14 is a view for explaining a structure of a baffle of the dual path condenser of the refrigerator of FIG. 10.
Figure 15:
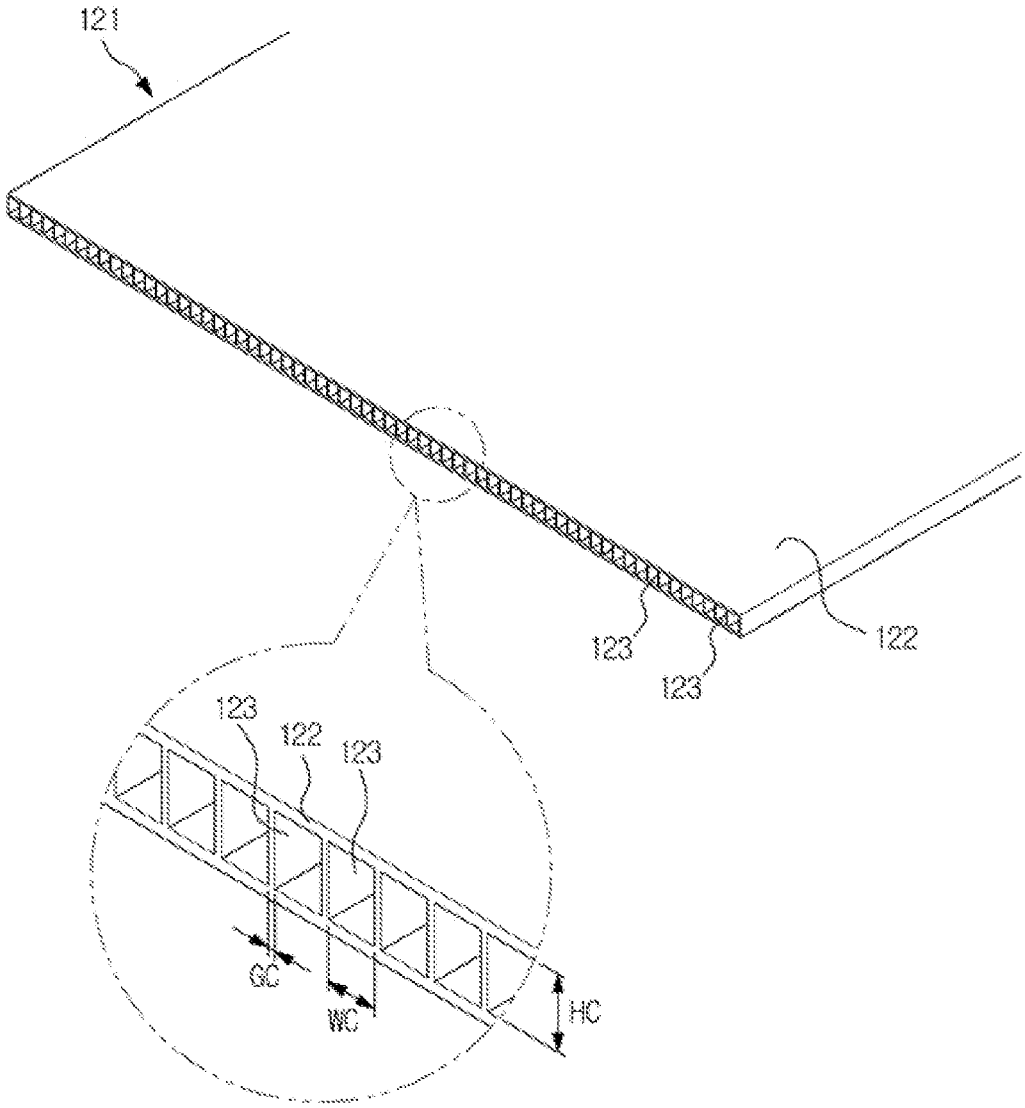
FIG. 15 is a view illustrating a tube of the dual path condenser of the refrigerator of FIG. 10.
Figure 16:
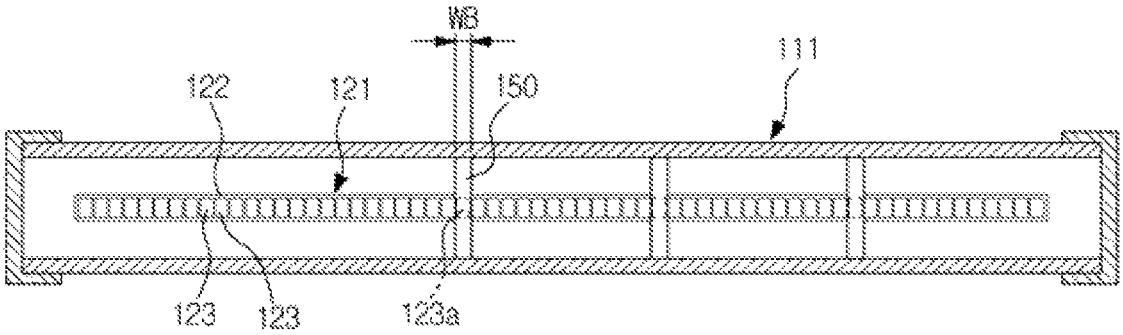
FIG. 16 is a view for explaining the relationship between the baffle and the tube of the dual path condenser of the refrigerator of FIG. 10.

FIG. 11 is a view illustrating a dual path condenser 101 of the refrigerator 5 of FIG. 10, FIG. 12 is a view illustrating the dual path condenser of the refrigerator of FIG. 11 in an A direction, FIG. 13 is a view illustrating a state in which condensation paths of the dual path condenser of the refrigerator of FIG. 12 are unfolded, FIG. 14 is a view for explaining a structure of a baffle of the dual path condenser 101 of the refrigerator 5 of FIG. 10, FIG. 15 is a view illustrating a tube of the dual path condenser 101 of the refrigerator 5 of FIG. 10, and FIG. 16 is a view for explaining the relationship between the baffle and the tube of the dual path condenser 101 of the refrigerator 5 of FIG. 10.

The configuration of the dual path condenser 101 according to the present disclosure will be described with reference to FIGS. 11 through 16 in detail. As illustrated in FIG. 11, the dual path condenser 101 includes a plurality of headers 111 and 112 through which a refrigerant is introduced or flows out, a flat tube 121 which may be stacked, that allows the space between the plurality of headers 111 and 112 to communicate, and heat dissipation fins 150 that contact the tube 121.

The plurality of headers 111 and 112 include a first header 111 and a second header 112, and a first inlet 131 through which a first refrigerant is introduced, a second inlet 133 through which a second refrigerant is introduced, and a second outlet 134 through which the second refrigerant flows out may be disposed at the first header 111. A first outlet 132 through which the first refrigerant flows outs may be disposed at the second header 112.

As illustrated in FIG. 10, the first inlet 131 may be connected to the first compressor 32, the first outlet 132 may be connected to the first expansion valve 34, the second inlet 133 may be connected to the second compressor 42, and the second outlet 134 may be connected to the second expansion valve 44.

Also, as illustrated in FIG. 13, the dual path condenser 101 includes a first condensation path 141 on which the first refrigerant introduced through the first inlet 131 is condensed and is guided to the first outlet 132, and a second condensation path 142 on which the second refrigerant introduced through the second inlet 133 is condensed and is guided to the second outlet 134. The first condensation path 141 and the second condensation path 142 are separately formed so that mixing of the first refrigerant and the second refrigerant may be prevented.

The first condensation path 141 and the second condensation path 142 may be formed by internal spaces 111*f* and 112*f* of the headers 111 and 112 and channels 123 of the tube 121.

In detail, the first header 111 has an outer wall 111*a* of which both ends are open and which has the internal space 111*f*, and an opening 111*b* that is formed in parallel to the outer wall 111*a* and communicates with the internal space 111*f*. In this case, an opening 111*b* may be formed and may be sealed by the tube 121. Header caps 111*d* and 111*e* may be combined with both open ends of the first header 111 and may be sealed.

Similarly, the second header 112 also has the same configuration as the first header 111, i.e., has an outer wall 112*a* of which both ends are open and which has the internal space 112*f*, and an opening 112*b* that is formed in parallel to the outer wall 112*a* and communicates with the internal space 112*f*. In this case, an opening 112*b* may be formed and may be sealed by the tube 121. Header caps 112*d* and 112*e* may be combined with both open ends of the first header 112 and may be sealed.

The tube 121 is an integrated flat tube having a plurality of channels 123, and predetermined portions of both ends of the tube 121 are inserted into the internal space 111*f* of the first header 111 and the internal space 112*f* of the second header 112 through the opening 111*b* of the first header 111 and the opening 112*b* of the second header 112.

In this case, the insertion depth of the tube 121 may be limited by at least one baffle 160 disposed at the headers 111 and 112. The baffle 160 is disposed in the internal spaces 111*f* and 112*f* of the headers 111 and 112 so as to partition off the internal spaces 111*f* and 112*f* of the headers 111 and 112 and to guide the flow of the refrigerant. Since the cross-section of the first header 111 is shown in FIG. 13, referring to FIG. 13, a stopper (see 161 of FIG. 14) is formed in the baffle 160 so as to limit the insertion depth of the tube 121.

The stopper 161 may have the shape of a groove that is depressed toward the inside of the stopper 161 so as to accommodate portions of the tube 121. The stopper 161 may include a first support face 161*a* that prevents movement in a direction in which the tube 121 is inserted into the headers 111 and 112, and a second support face 161*b* and a third support face 161*c* that prevent movement in a direction perpendicular to the insertion direction of the tube 121.

The baffle 160 may have an insertion protrusion 162 so as to be combined with the headers 111 and 112, and position adjustment holes 111*c* and 112*c* through which the insertion protrusion 162 may be inserted are formed in outer walls 111*a* and 112*a* that are opposite to the openings 111*b* and 112*b* of the headers 111 and 112. Thus, after the position of the baffle 160 is adjusted by inserting the insertion protrusion 162 of the baffle 160 into the position adjustment holes 111*c* and 112*c* of the headers 111 and 112, the baffle 160 and the headers 111 and 112 may be combined with each other, for example, by brazing.

The tube 121 is formed as one body, as illustrated in FIG. 15 and may include a flat type body 122 and the plurality of channels 123 through which the refrigerant flows and which are formed on the body 122. The heat dissipation fins 150 contact the body 122. Each of the heat dissipation fins 150 may be disposed to have a width corresponding to the width of the tube 121 so as to effectively dissipate heat transferred to the entire body 122.

Each of the plurality of channels 123 of the tube 121 may be formed to have a predetermined width WC and a predetermined height HC and may have a simple shape with a uniform gap GC.

In this case, ends of the tube 121 are inserted into the internal spaces 111*f* and 112*f* of the headers 111 and 112. Since the inserted tube 121 is naturally supported by the baffle 160, no additional shape for this support is necessary and thus the tube 121 may be easily manufactured.

As illustrated in FIG. 13, portions 124 of the plurality of channels 123 constitute portions of the first condensation path 141. This is referred to as a first channel portion 124. Also, the other portions 125 of the channels 123 constitute portions of the second condensation path 142. This is referred to as a second channel portion 125. Thus, the first channel portion 124 is formed at portions of the body 122, and the second channel portion 125 is formed at the other portions of the body 122.

Here, when the second refrigerating unit does not operate and only the first refrigerating unit operates, i.e., when the refrigerant does not flow through the second channel portion 125 and flows only through the first channel portion 124, heat of the refrigerant is transferred to the entire body 122 and may be dissipated through the entire body 122. That is, even when the refrigerant flows only through the first channel portion 124, heat of the refrigerant is transferred to portions of the body 122 that constitute the first channel portion 124 and the other portions of the body 122 that constitute the second channel portion 125 such that heat dissipation may be performed through the entire body 122.

In contrast, when the first refrigerating unit does not operate and only the second refrigerating unit operates, i.e., when the refrigerant does not flow through the first channel portion 124 and flows only through the second channel portion 125, heat of the refrigerant is transferred to the entire body 122. Thus, heat dissipation may be performed through the entire body 122.

Thus, since heat dissipation is performed through the entire body 122 in either case, a heat dissipation area may be increased, and as such, a heat dissipation effect may be improved. Of course, when the first refrigerating unit and the second refrigerating unit operate simultaneously and the refrigerant flows through the first channel portion 124 and the second channel portion 125 simultaneously, the effect of increasing the heat dissipation area may be cancelled out.

Furthermore, even when the refrigerant flows through one of the first channel portion 124 and the second channel portion 125, heat of the refrigerant is transferred to the entire body 122 and thus may be dissipated through all of the heat dissipation fins 150 that contact the body 122.

Unlike the integrated tube according to the present embodiment, when a plurality of tubes that are separated from each other are used and the plurality of tubes constitute different condensation paths, the heat dissipation fins 150 contact all of the plurality of tubes so that the effect of increasing the heat dissipation area of the present embodiment may be expected. That is, even when the plurality of tubes are separated from each other, heat may be transferred to the entire body 122 through the heat dissipation fins 150.

Some of the plurality of channels 123 of the tube 121 may be blocked by the baffle 160. In FIG. 13, channels 123*a* that are blocked by the baffle 160 are shaded in. In this way, the channels 123*a* that are blocked by the baffle 160 may not constitute any of the first condensation path 124 and the second condensation path 125.

Since the refrigerant may be introduced through the blocked channels 123*a* and outlets of the blocked channels 123*a* are blocked by the baffle 160, the flow of the refrigerant does not occur and may be stopped. Of course, even though the channels 123*a* to be blocked by the baffle 160 may be pre-blocked when the tube 121 is manufactured, this causes an increase in material cost. Thus, it is effective in view of cost and convenience of processing to, as in the present embodiment, manufacture the tube 121 in such a way that the plurality of channels 123 are formed to the predetermined width WC and the uniform gap GC and to block the channels 123*a* using the baffle 160.

To this end, the width (see WB of FIG. 16) of the baffle 160 may correspond to or to be larger than the width (see WC of FIG. 16) of each channel 123.

All of the components of the dual path condenser 101 having the above configuration may be combined with each other, for example, by brazing so as to prevent water leakage of the refrigerant. That is, all of the headers 111 and 112, the header caps 111*d*, 111*e*, 112*d*, and 112*e*, the baffle 160, the tube 121, and the heat dissipation fins 150 may be coated with a cladding material for brazing.

Thus, the baffle 160 is temporarily combined with the internal spaces 111*f* and 112*f* of the headers 111 and 112, the header caps 111*d*, 111*e*, 112*d*, and 112*e* are put on both open ends of the headers 111 and 112, the tube 121 is inserted into the headers 111 and 112, and the heat dissipation fins 150 are disposed between the tubes 121 and then put into a brazing furnace, thereby manufacturing the dual path condenser 101.

When the temporarily-manufactured dual path condenser 101 is heated at a temperature of about 600° C. to 700° C. in the brazing furnace, the cladding material coated on the components of the dual path condenser 101 is melted so that joints of the components are sealed and simultaneously the components are firmly joined. Thus, the joints of the components are required to be formed with a predetermined gap so as to seal spaced gaps using the melted cladding material.

Here, temporarily forming the baffle 160 in the internal spaces 111*f* and 112*f* of the headers 111 and 112 may be easily performed by inserting the insertion protrusion 162 of the baffle 160 into the position adjustment holes 111*c* and 112*c* of the headers 111 and 112.

The structure of the dual path condenser 101 according to an embodiment of the present disclosure does not apply only to a condenser but may apply to an evaporator, a refrigerator, and an air conditioner.

As described above, the refrigerating unit of FIG. 10 is a refrigerating unit that circulates a plurality of refrigerating cycles individually. The refrigerating unit of FIG. 10 includes the plurality of individual condensation paths 141 and 142, the tube 121 that is formed as one body so as to dissipate heat of the refrigerant through the entire body even when the refrigerant flows through one of the plurality of condensation paths 141 and 142, and the dual path condenser 101 having the integrated heat dissipation fins 150.

Therefore, heat generation components may be disposed in the machine compartment 23 with the limited capacity, a heat dissipation efficiency of a plurality of refrigerating cycles may be improved, and energy consumed for heat dissipation may be reduced.

According to the spirit of the present disclosure, since a refrigerator circulates a plurality of refrigerating cycles individually using a plurality of compressors, a freezer compartment and a refrigerator compartment are cooled in different temperature ranges so that power consumption may be reduced.

In this case, heat generated in a plurality of refrigerating cycles may be effectively dissipated.

Also, since a plurality of compressors and a condenser are disposed in a machine compartment, the machine compartment may be easily arranged.

In particular, using a dual path condenser having a plurality of condensation paths that are individually formed, a plurality of refrigerating cycles may be circulated using one condenser so that the space utility of the machine compartment may be increased.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body;

a freezer compartment formed in the body;

a refrigerator compartment that is formed in the body and insulated from the freezer compartment;

a machine compartment insulated from the freezer compartment and the refrigerator compartment;

a freezer compartment compressor disposed in the machine compartment so as to circulate a freezer compartment refrigerating cycle in which cold air is supplied to the freezer compartment;

a refrigerator compartment compressor disposed in the machine compartment so as to circulate a refrigerator compartment refrigerating cycle in which cold air is supplied to the refrigerator compartment;

a condenser disposed in the machine compartment so as to condense a refrigerant compressed by the freezer compartment compressor and/or to condense a refrigerant compressed by the refrigerator compartment compressor; and a blower fan disposed in the machine compartment so as to forcibly cause air to flow, wherein the freezer compartment compressor is disposed to be adjacent to one sidewall of the machine compartment from a center of an inside of the machine compartment, the refrigerator compartment compressor is disposed to be adjacent to the other sidewall of the machine compartment from the center of the inside of the machine compartment, and the condenser is disposed between the freezer compartment compressor and the refrigerator compartment compressor, and the blower fan allows air to forcibly flow from the refrigerator compartment compressor to the freezer compartment compressor via the condenser.

2. The refrigerator according to claim 1, wherein the blower fan is disposed between the refrigerator compartment compressor and the condenser, absorbs air from the refrigerator compartment compressor and ejects air toward the condenser.

3. The refrigerator according to claim 2, wherein the refrigerator compartment compressor, the blower fan, the condenser, and the freezer compartment compressor are successively disposed in one straight line.

4. The refrigerator according to claim 1, wherein the blower fan is disposed between the condenser and the freezer compartment compressor, absorbs air from the condenser, and ejects air toward the freezer compartment compressor.

5. The refrigerator according to claim 4, wherein the refrigerator compartment compressor, the condenser, the blower fan, and the freezer compartment compressor are successively disposed in one straight line.

6. The refrigerator according to claim 1, wherein the machine compartment has one open portion and comprises a machine compartment cover that is detachably combined with the open portion of the machine compartment so as to open or close the open portion of the machine compartment.

7. The refrigerator according to claim 6, wherein an inlet through which air is introduced into the machine compartment and an outlet through which air flows out from the machine compartment, are formed in the machine compartment cover.

8. The refrigerator according to claim 1, wherein the blower fan is an axial flow fan.

9. A refrigerator comprising:

a body;

a freezer compartment formed in the body;

a refrigerator compartment that is formed in the body and insulated from the freezer compartment;

a machine compartment insulated from the freezer compartment and the refrigerator compartment;

a freezer compartment compressor disposed in the machine compartment so as to circulate a freezer compartment refrigerating cycle in which cold air is supplied to the freezer compartment;

a refrigerator compartment compressor disposed in the machine compartment so as to circulate a refrigerator compartment refrigerating cycle in which cold air is supplied to the refrigerator compartment; and a blower fan disposed in the machine compartment so as to cool the machine compartment, wherein the blower fan allows air to forcibly flow from the refrigerator compartment compressor to the freezer compartment compressor.

10. The refrigerator according to claim 9, wherein the blower fan is an axial flow fan, and the refrigerator compartment compressor, the blower fan, and the freezer compartment compressor are successively disposed in one straight line.

11. The refrigerator according to claim 9, wherein the freezer compartment compressor is disposed to be slanted toward one sidewall of the machine compartment from a center of an inside of the machine compartment, and the refrigerator compartment compressor is disposed to be slanted toward the other sidewall of the machine compartment from the center of the inside of the machine compartment.

12. The refrigerator according to claim 9, further comprising:

a freezer compartment condenser that condenses a refrigerant compressed by the freezer compartment compressor; and a refrigerator compartment condenser that condenses a refrigerant compressed by the refrigerator compartment compressor, wherein one of the freezer compartment condenser and the refrigerator compartment condenser is disposed between the freezer compartment compressor and the refrigerator compartment compressor in the machine compartment.

13. The refrigerator according to claim 9, further comprising a dual path condenser having a first condensation path on which a refrigerant compressed by the freezer compartment compressor is condensed, and a second condensation path on which a refrigerant compressed by the refrigerator compartment compressor is condensed and which is formed independently of the first condensation path, wherein the dual path condenser is disposed between the freezer compartment compressor and the refrigerator compartment compressor in the machine compartment.

14. A refrigerator comprising:

a body having an inner case and an outer case;

a plurality of storage compartments formed in the body;

a machine compartment insulated from the plurality of storage compartments;

a first compressor and a second compressor disposed in the machine compartment;

a first condenser disposed in the machine compartment to condense a refrigerant compressed by the first compressor and/or the second compressor; and a blower fan disposed in the machine compartment to cool the machine compartment, wherein the blower fan allows air to flow from one of the first compressor and the second compressor to other one of the first compressor and the second compressor via the first condenser.

15. The refrigerator according to claim 14, further comprising a second condenser disposed outside of the machine compartment.

16. The refrigerator according to claim 15, wherein the second condenser is a heat dissipation pipe.

17. The refrigerator according to claim 16, wherein the heat dissipation pipe is attached to the inner or outer surface of the outer case so that heat of the heat dissipation pipe is transferred to the outer case.

18. The refrigerator according to claim 16, wherein the heat dissipation pipe is disposed between the inner case and the outer case.

* * * * *